US006031339A

United States Patent [19]

Andrews

[11] Patent Number: 6,031,339

[45] Date of Patent: Feb. 29, 2000

[54] EFFICIENT ELECTRONIC BALLAST FOR FLUORESCENT TUBES

[75] Inventor: Michael Andrews, Fort Collins, Colo.

[73] Assignee: Hewlett-Packard Company, Palo Alto, Calif.

[21] Appl. No.: 09/240,793

[22] Filed: Jan. 3, 1999

[51] Int. Cl.[7] ..... H05B 37/02

[52] U.S. Cl. ..... 315/224; 315/209 R; 315/307; 315/DIG. 7

[58] Field of Search ..... 315/224, 209 R, 315/212, 276, 279, 283, 307, DIG. 5, DIG. 7, 291, 219, 244, 206, 200 R

[56] References Cited

U.S. PATENT DOCUMENTS

| | | | |
|---|---|---|---|
| 5,008,596 | 4/1991 | Kastl et al. | 315/219 |
| 5,349,270 | 9/1994 | Roll et al. | 315/DIG. 7 |
| 5,402,043 | 3/1995 | Nilssen | 315/307 |
| 5,677,602 | 10/1997 | Paul et al. | 315/307 |
| 5,744,915 | 4/1998 | Nilssen | 315/209 R |
| 5,747,942 | 5/1998 | Ranganath | 315/224 |

*Primary Examiner*—Don Wong
*Assistant Examiner*—Thuy Vinh Tran
*Attorney, Agent, or Firm*—Edward L. Miller

[57] ABSTRACT

An air gapped inductance and a capacitance form a series resonance that is itself in series with a flourescent tube. The resulting series resonant network is permanently connected to one (+) side of the DC supply, while the other end is switched between that (+) side of the DC supply and the other (−) side of the DC supply. Switching occurs in synchronism with the different polarities of the half-cycles for the current circulating in the resonant circuit. In series with the current in the resonant circuit is the primary of a phase splitter driver transformer having separate secondaries phased to control FET switches to do the aforementioned switching, and whose turns ratios are selected to determine the duty cycles with which the resonant circuit is switched. The switched end is connected to the one (+) end of the DC supply for its entire associated half cycle. For significantly less than the remaining half cycle it is switched to the other (−) side of the DC supply to restore energy to the circuit and replace that which has been dissipated in the flourescent lamp. During the remaining balance of that remaining half cycle neither FET switch is closed, and current flows through a diode that bypasses the FET that is connected to the + side of the DC supply.

1 Claim, 1 Drawing Sheet

EFFICIENT ELECTRONIC BALLAST FOR FLUORESCENT TUBES

REFERENCE TO ISSUED PATENTS

The subject matter of the present Patent Application is related to a field of interest (voltage fed resonance in an electronic ballast for flourescent light fixtures) that is the same field of interest as various other issued Patents. An appreciation of two of those Patents may be helpful to a reader having a limited background in this area. For that reason, U.S. Pat. No. 5,008,596 (R. Kasti, et al., Apr. 16, 1991) and U.S. Pat. No. 5,349,270 (U. Roll, et al., Sep. 20, 1994) are hereby incorporated herein by reference.

BACKGROUND OF THE INVENTION

The many advantages of flourescent lighting (e.g., low power consumption, long life) have, in recent years, spurred development of battery operated lamps using inverters (say, for camping) and the compact flourescent light fixtures intended to be screw-in replacements for standard incandescent light bulbs. Even line operated applications where, in the past, the venerable magnetic ballast would have been employed (e.g., permanently installed overhead lighting fixtures in structures), the magnetic ballast has begun to see its replacement by electronic ballasts (which, of course, are also found in the compact flourescent replacements for incandescent lamps). Accordingly, there has been much commercial interest in electronic ballasts. For a general introduction to what a ballast needs to do and the various approaches to such ballasts, see the eminently readable and informative Motorola application note AN1049D (1990, 1994). Additional background may be gained from the incorporated Patents. The subject matter of the present invention concerns what that application note terms a "voltage fed resonant circuit" type of electronic ballast.

Despite all the development that has gone on, there is still room for improvement. First, the circuit should be efficient. Efficiency has many implications. The reduced heat allows longer component life and increased freedom of circuit deployment to product situations that might not otherwise be possible. The flourescent bulbs themselves seem to produce more light for a given power input thereto when the applied power is sinusoidal and of fairly high frequency, say, 50 KHz. Unfortunately, the sine wave needed for, say, an F40T 12 is substantial; perhaps 750 VRMS to start it and approximately hall that to keep it going once started. It is not trivial to keep distortion in the sine wave small under such conditions, especially since the tube is not a simple resistive load. Finally, if no special mechanism is included to preheat the electrodes to assist in conditioning the mercury vapor in the tube, the tube can be hard to start, or can resist the transition from a start-up phase to an operating phase. It would be desirable if the conventional voltage fed electronic ballast could be improved to be more efficient, have a less distorted sine output, while starting reliably without resort to any separate "starters" for preheating the electrodes.

SUMMARY OF THE INVENTION

An air gapped inductance and a capacitance form a series resonance that is itself in series with a flourescent tube. The resulting series resonant network is permanently connected to one (+) side of the DC supply, while the other end is switched between that (+) side of the DC supply and the other (−) side of the DC supply. Switching occurs in synchronism with the different polarities of the half-cycles for the current circulating in the resonant circuit. In series with the current in the resonant circuit is the primary of a phase splitter driver transformer having separate secondaries phased to control FET switches to do the aforementioned switching, and whose turns ratios are selected to determine the duty cycles with which the resonant circuit is switched. The switched end is connected to the one (+) end of the DC supply for its entire associated half cycle. For significantly less than the remaining half cycle the switched end is connected to the other (−) side of the DC supply to restore energy to the series resonant circuit and replace that which has been dissipated in the flourescent lamp. During the remaining balance of that remaining half cycle neither FET switch is closed, and current flows through a diode that bypasses the FET that is connected to the +side of the DC supply. The air gapped inductance aids with starting and improves efficiency by reducing distortion in the sine wave voltage driving the lamp.

DESCRIPTION OF A PREFERRED EMBODIMENT

Figure 1:
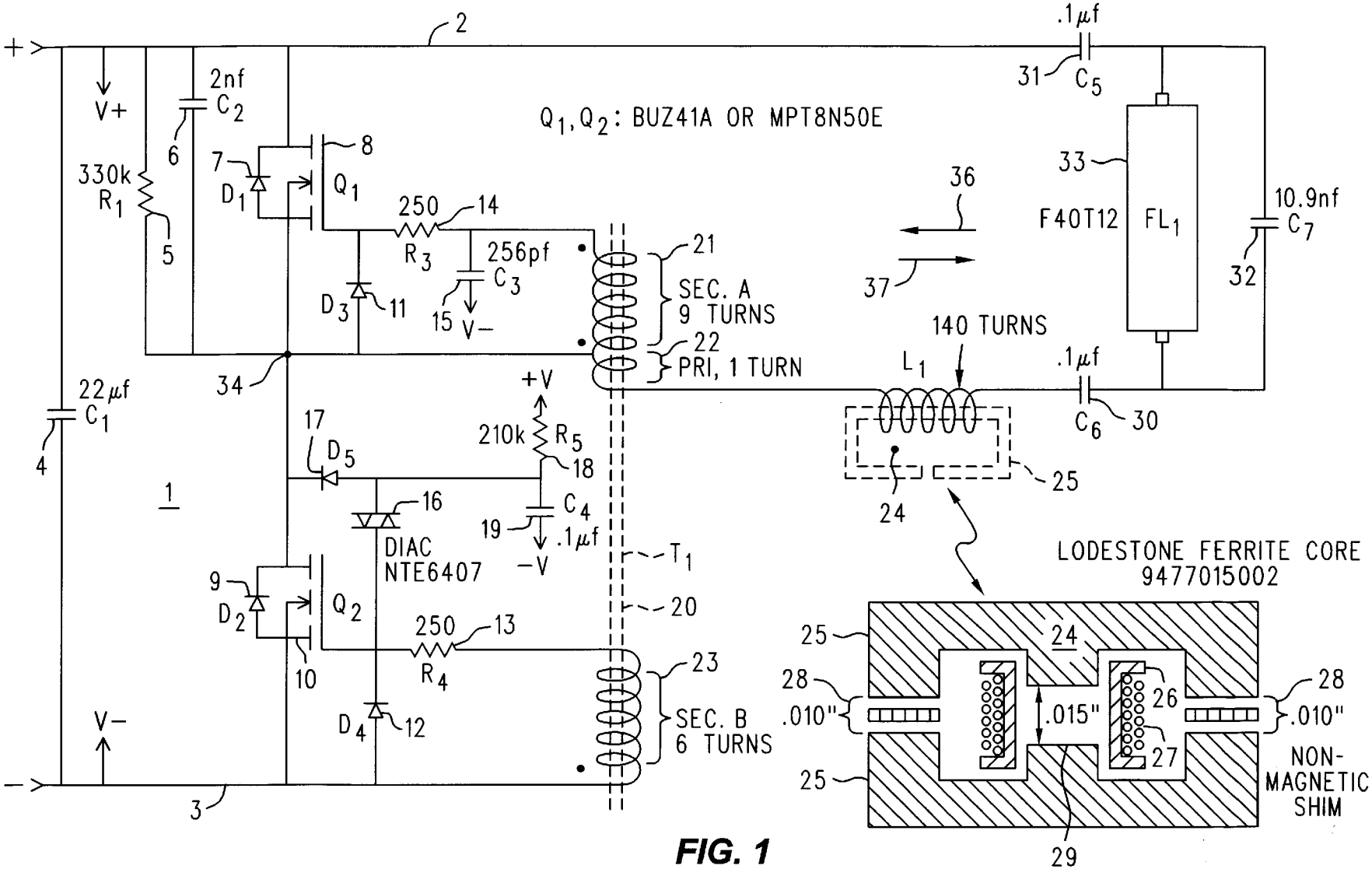
FIG. 1 is a partial schematic diagram of an electronic ballast for a flourescent lamp employing a voltage fed resonant circuit and incorporating the invention.

Refer now to FIG. 1, wherein is shown a partial schematic diagram of a circuit 1 for a flourescent lamp electronic ballast employing a voltage fed resonant circuit. The circuit 1 is intended to operate directly from the line voltage of the AC mains through suitable full-wave rectification and filtering (which may also included voltage doubling), and with EMI (Electro Magnetic Interference) filtering. The power rectification and filtering and EMI filtering are entirely conventional, and have been omitted for the sake of brevity. It will further be appreciated that the circuit 1 might also be operated from a battery powered DC to DC converter, if such were desired.

We shall briefly discuss the overall operation of the circuit 1, and then focus on the improvements found therein. The plus side of the DC supply is applied to line 2, (V+), while the negative side is applied to line 3 (V−). Capacitor $C_1$ (4) is simply additional filtering, and may be thought of as an extension of the omitted power and EMI filters.

The flourescent lamp $FL_1$ 33, which may be an F40T12, is in parallel with $C_7$ 32, which parallel combination is in series with $C_5$ 31, $C_6$ 30 and $L_1$ 24. At turn on the lamp 33 has an impedance of several megohms, and ignites when exposed to the high voltage developed across the relatively small value of $C_7$ 32. This series parallel combination effectively becomes simply a series combination once the lamp $FL_1$ 33 fires, or turns on, as $C_7$ 32 is then for all practical purposes shorted out by the low (200–300 ohms) impedance of the lamp 33. That series combination resonates with $L_1$ 24, and is hereinafter termed "the series resonant circuit".

Note that the series resonant circuit of $FL_1$ 33, $C_5$ and $C_6$ (30–32) and $L_1$ 24 is permanently connected at the $C_5$ end to the plus side 2 of the DC power supply. The other end (at $L_1$ 24) is switched between the plus side 2 of the DC supply, and the minus side 3, by oscillatory action of FET's $Q_1$ 8 and $Q_2$ 10, respectively. Here are the paths for the current in the series resonant circuit. To get the oscillatory action started, and to replace power dissipated by $FL_1$, $Q_2$ 10 is turned on. Thus, if we were to follow the electrons, they would go from the minus side 3 of the supply, up through FET $Q_2$ to switching node 34, and thence through the one turn primary 22 to the series resonant circuit in the direction of arrow 35 until reaching the positive side 2 of the DC supply. Let us term the half cycles that are associated with $Q_2$ 10 being on "charging" half cycles. We shall term the remaining half cycles (those with a reversed direction of current in the series resonant circuit) "idling" half cycles. Clearly, there has to be a completed path for (electron) current in the direction of arrow 36 through the series resonant circuit during idling half cycles, or resonance would not be sustainable. That path is from switching node 34, through a turned on FET $Q_1$ 8 to the plus side 2 of the DC supply, and it is in effect during the entire idling half cycle, consistent with not having both transistors on at the same time. ( It is painfully clear that FET's $Q_1$ and $Q_2$ had not better ever both be on at the same time!)

It will be appreciated that once a steady state operating condition has been reached it is not desirable for $Q_2$ 10 to be on for any larger portion of the charging half cycle than is necessary to replace power dissipated by $FL_1$ 33. And indeed, it is typical for it to be on for about half, or a little less, of the charging half cycle. That means that there must be yet another path for current in the series resonant circuit (i.e., for those periods of time that are part of the charging half cycle—meaning $Q_1$ is off—but during which $Q_2$ is also off). That fraction of the charging cycle is treated as if it were additional idling time, and during that additional idling time the current flows through diode $D_1$ 7. Diode $D_2$ 9 is never used, but it's there anyway, since $D_1$ is part of (is located in the same package as) $Q_1$ and $D_2$ is part of $Q_2$. The manufacturer of the transistors makes them that way, since they are intended for this type of service.

$R_1$ 5 and $C_2$ 6 are believed to protect $Q_1$ by limiting the resonant rise in voltage that it would otherwise be exposed to if the lamp $FL_1$ 33 never started, were burned out or absent. Resistors $R_3$ 14 and $R_4$ 13, along with diodes $D_3$ 11 and $D_4$ 12, are believed to protect their associated transistors during various conceivable failures of other components. (We "believe" these things, since some segments of this circuit originate in the prior art, and after a while, their purposes is no longer explicitly stated by those who write about them.)

Certain parts of the circuit 1 are there only for start-up, and are described next. DIAC 16 cooperates in a known way with $R_5$ 18 and $C_4$ 19 to start oscillation upon the initial application of DC power by briefly forcing $Q_2$ 10 on. Once this task is accomplished, diode $D_5$ 17 disables this function, allowing independent oscillation to proceed. Capacitor $C_3$ 15 also assists in successful turn-on by ensuring that $Q_1$ 8 stays off while $Q_2$ 10 is being forced on.

There follows now a description of how the oscillatory current in the series resonant circuit is used to switch FET's $Q_1$ 8 and $Q_2$ 10 to sustain the oscillation. The current through the series resonant circuit passes through the one turn primary of $T_1$ 20. The circuit operation is reminescent of the old Armstrong (tickler coil) oscillator, except that this is a push-pull version. That is, the secondary winding A 21 produces a voltage that is of the polarity needed to turn $Q_1$ 8 on when the direction of the (electron) current is that of arrow 36, which is to say, during the idling half cycle. During that same time secondary winding B 23 produces a voltage that is of the opposite polarity that merely further biases an already not-on $Q_2$ 10 to be off. During the charging half cycle the polarities are reversed, so $Q_1$ 8 is biased off, while $Q_2$ 10 will conduct for some portion of that charging cycle. The voltages produced at these secondaries A 21 and B 23 are transduced signals that faithfully represent the waveform of the current in the series resonant circuit. The A secondary 21 has a larger number of turns than the B secondary 23. This allows the A secondary to drive $Q_1$ into conduction for almost the entire idling half cycle. The smaller number of turns on the B secondary reduce the percentage of the charging half cycle that produces a large enough signal to drive $Q_2$ into conduction, thus setting the drive level for the series resonant circuit. Transformer $T_1$ is preferably wound upon a toroidal core of ferrite.

We turn now to the nature of $L_1$, which is an air gapped ferrite inductor. Actually, the gap or gaps of interest need not necessarily be of actual air. They could be of other material, so long as there is not any stuff in there that might cause magnetic mischief. Various plastics are suitable, but any metals, even if not magnetic, are suspect, owing to the losses (eddy currents, etc.) that may result. Ferrite is a necessity because of the frequency of operation and the need for low losses. The inductor $L_1$ 24 resonates with the series combination $C_5$ 31 and $C_6$ 30 (i.e., with 0.05 uf) at a frequency of 50 KHz.

$L_1$ itself may be constructed as follows. Two round ferrite cores 25 (e.g., Lodestone p/n 9477015002) whose cross sections resemble an "E" are separated by low loss non-magnetic shim material 28 (sheet plastic) that is 0.010"thick. The center posts of the cores 25 have each been relieved by 0.0025" to produce an additional 0.005", for a total of 0.015" at gap 29. A bobbin 26 carrying one hundred forty turns 27 of wire is slipped over the posts, and the whole works 24 is suitably glued or potted.

It is not entirely, clear, at present, why the gapped ferrite inductor 24 provides the improvement that it does. We are aware that inductors are sometimes gapped to prevent saturation of the core material, as in the swinging chokes used in power supplies experiencing wide swings in current supplied to the load. The gap in a swinging choke is an expedient that produces improved regulation without solving the underlying problem of needing a (bigger) choke that saturates less easily. Putting a same valued inductor having a less readily saturated core in place of gapped $L_1$ 24 does not produce the improvement that is seen with the gapped part. That is, premature saturation of the core 25 in $L_1$ 24 is not believed to be "the problem". The sceptic is reminded that the series resonant circuit of interest includes the lamp $FL_1$ 33, which is not a simple well behaved lump impedance. Some commentators have called such lamps and similar loads "active loads", since their instantaneous impedance changes in irregular ways during operation. We believe that $FL_1$ exhibits a medium case of non-linear dynamics. It is believed that the gap in the inductor 24 compensates for that in ways that are beneficial. The quality of the sinusoidal oscillation in the series resonant circuit improved significantly as the gap was gradually introduced, the tube started more reliably, and the overall circuit efficiency went from a percentage in the mid eighties to the low nineties.

I claim:

1. An electronic ballast for a flourescent lamp comprising:

a first DC power supply conductor distributing a supply voltage;

a second DC power supply conductor that is the return side of the supply voltage;

first and second switching transistors in series, the series combination thereof connected between the first and second power supply conductors, and the junction of the first and second switching transistors with each other being a switched node;

an inductor having a gapped core in series with a capacitance and a flourescent lamp, these three in series combination forming a series resonant circuit having first and second terminals at the extreme ends of the series combination;

the first terminal of the series resonant circuit being connected to the first DC power supply conductor;

a transformer having a primary winding and first and second secondary windings, the primary winding being connected between the second terminal of the series resonant circuit and the switched node;

the first secondary winding coupled to control the conduction of the first switching transistor;

the second secondary winding being of opposite phase with respect to the first secondary winding and coupled to control the conduction of the second switching transistor; and the size of the gap in the core of the inductor being selected to minimize distortion in a sinusoidal voltage developed across the flourescent lamp.

* * * * *

UNITED STATES PATENT AND TRADEMARK OFFICE

CERTIFICATE OF CORRECTION

PATENT NO. : 6,031,339
DATED : February 29, 2000
INVENTOR(S) : Michael Andrews

It is certified that error appears in the above-identified patent and that said Letters Patent is hereby corrected as shown below:

Title page,
ABSTRACT,
Lines 2 and 18, "flourescent tube" should read -- fluorescent tube --

Column 1,
Lines 7, 17, 19, 26 and 42, "flourescent tube" should read -- fluorescent tube --

Column 2,
Lines 21, 27 and 45, "flourescent tube" should read -- fluorescent tube --

Column 4,
Line 45, "sceptic" should read -- skeptic --
Line 60, "flourescent tube" should read -- fluorescent tube --

Signed and Sealed this

Twenty-third Day of April, 2002

*Attest:*

*Attesting Officer*

JAMES E. ROGAN
*Director of the United States Patent and Trademark Office*